United States Patent [19]

Long et al.

[11] 4,419,219

[45] Dec. 6, 1983

[54] ADSORPTION OF BASIC ASPHALTENES ON SOLID ACID CATALYSTS

[75] Inventors: Robert B. Long, Atlantic Highlands; Fred A. Caruso, Elizabeth, both of N.J.

[73] Assignee: Exxon Research and Engineering Co., Florham Park, N.J.

[21] Appl. No.: 305,267

[22] Filed: Sep. 24, 1981

[51] Int. Cl.[3] ..... C10G 11/04; C10G 25/00; C10G 25/12

[52] U.S. Cl. ..... 208/86; 208/120; 208/122; 208/123; 208/309

[58] Field of Search ..... 208/86, 91, 122, 123, 208/120, 309, 254 R, 251 R, 310 R, 310 Z

[56] References Cited

U.S. PATENT DOCUMENTS

| | | | |
|---|---|---|---|
| 2,956,004 | 10/1960 | Conn et al. | 208/91 |
| 3,530,066 | 9/1970 | Kuwata et al. | 208/309 |
| 4,069,268 | 1/1978 | Siskin et al. | 208/134 |
| 4,090,948 | 5/1978 | Schwarzenbek | 208/74 |
| 4,090,951 | 5/1978 | Smith | 208/91 |
| 4,123,379 | 10/1978 | Gates et al. | 252/184 |
| 4,125,457 | 11/1978 | Brennan et al. | 208/254 R |
| 4,137,154 | 1/1979 | Audeh | 208/254 R |
| 4,233,139 | 11/1980 | Murrell et al. | 208/112 |
| 4,244,811 | 1/1981 | Grenoble et al. | 208/122 |

OTHER PUBLICATIONS

Yen; *Shale Oil, Tar Sands, and Related Fuel Sources;* Am. Chem. Soc. (1976) pp. 30–33.

*Primary Examiner*—Patrick Garvin
*Assistant Examiner*—O. Chaudhuri
*Attorney, Agent, or Firm*—Edward M. Corcoran

[57] ABSTRACT

Basic asphaltenes are selectively removed from asphaltene-containing hydrocarbon feeds by contacting the feed with a solid acid, such as a solid acid cracking catalyst, which selectively adsorbs the basic asphaltenes present in the feed. The adsorption is carried out at a temperature below about 575° F. to avoid cracking the asphaltenes in the adsorption zone. The basic asphaltene-containing catalyst is then separated from the feed, the basic asphaltenes are cracked off the catalyst, the catalyst is regenerated by suitable techniques such as air burning and then recycled back to the adsorption zone. The basic asphaltene-reduced feed is sent to further processing.

10 Claims, 1 Drawing Figure

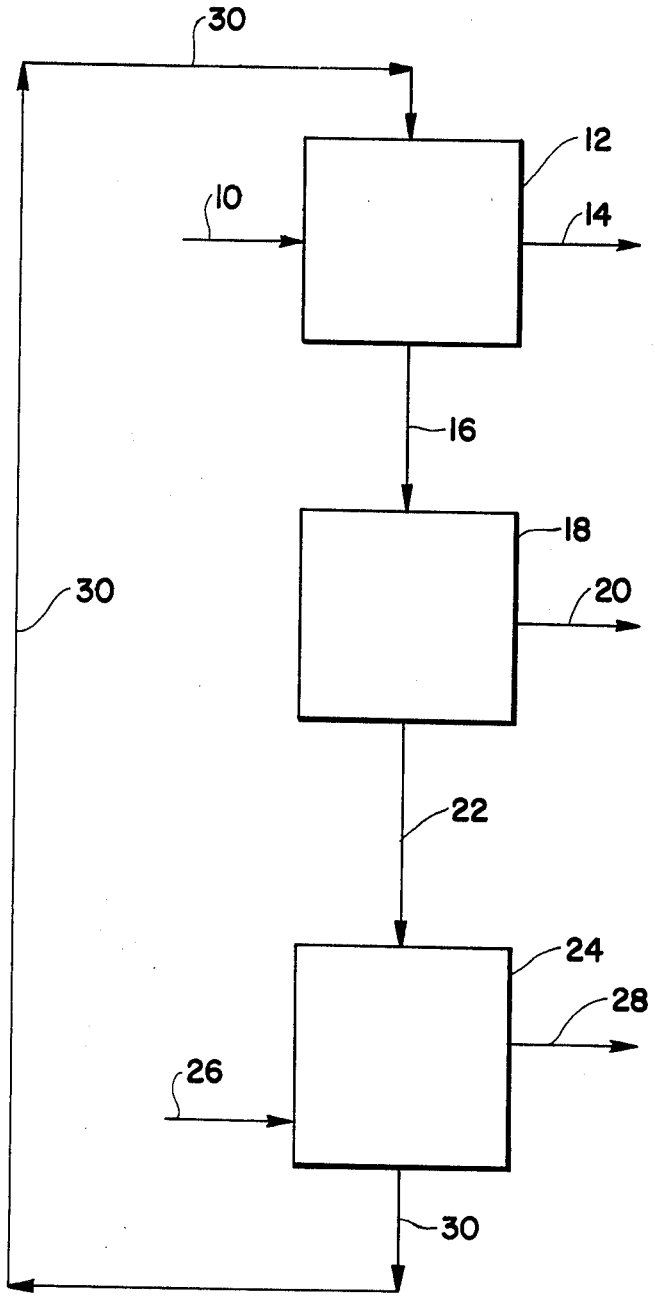
30
12
10
14
16
18
30
20
22
24
28
26
30

ADSORPTION OF BASIC ASPHALTENES ON SOLID ACID CATALYSTS

BACKGROUND OF THE INVENTION

1. Field of the Invention

This invention relates to selectively adsorbing basic asphaltenes on solid acids. More particularly, this process relates to the selective removal of basic asphaltenes from an asphaltene-containing hydrocarbon feed by contacting said feed with a solid acid catalyst at a temperature below about 575° F.

2. BACKGROUND OF THE DISCLOSURE

Conventional hydrodesulfurization, hydrodenitrogenation, hydrocracking, cat cracking, reforming and other hydroconversion processes cannot be used on feeds containing appreciable amounts of asphaltene materials due to coking and deactivation of the catalyst by the asphaltenes. Basic asphaltenes are the most troublesome in this regard.

It is known in the art that asphaltenes can be separated into basic and non-basic fractions using mineral acid separation techniques. Basic asphaltenes have been precipitated from various crude oils by potentiometric titration with perchloric acid and there are earlier reports of the use of potentiometric titration to determine basic nitrogen (Nicksic, S. W. and Jeffries-Harris, M. J., J. Inst. Petrol., 54 (532), 107–114 (1968)). H. Sternberg developed a technique for separating basic and non-basic asphaltenes from coal liquids by first dissolving the asphaltenes in toluene, followed by saturating the solution with anhydrous HCl which precipitates a basic asphaltene-HCl complex from the solution. The precipitate is filtered and the basic asphaltenes are recovered by treating the asphaltene-HCl complex with causic solution (Sternberg, H. W., Raymond, R., and Schweighardt, F. K., Science, 188, 49 (1975)). In this technique, the non-basic asphaltenes remain in the original toluene solution and are recovered from the filtrate by evaporating off the toluene.

Increasing world petroleum consumption and declining availability of high quality crude oils has forced both producers and refiners of petroleum alike to turn more and more to low quality, heavy crudes having relatively high residuum and concomitant high asphaltene contents. Further, synthetic feeds derived from Alberta Tar Sands, Cold Lake Crude, coal liquids, Venezualan tar sands and the like also contain appreciable amounts of asphaltenes. Therefore, there is a need for processes which can readily remove at least a portion of the asphaltenes, and particularly the basic asphaltenes, from feeds containing same to permit further processing of the asphaltene-reduced feed into useful products such as chemicals, solvents, fuels and lubricating oils. It would be particularly beneficial if such processes could also make liquid products out of the separated basic asphaltenes.

U.S. Pat. No. 3,691,063 discloses employing solid acid catalysts, such as silica-alumina, in a guard case operated at from 600°–1,000° F. to remove metals and asphaltenes from heavy feeds prior to hydrocracking same. Under these temperature conditions some of the adsorbed asphaltenes are cracked in-situ in the guard case. This in-situ cracking tends to coke the catalyst therein, thereby reducing both its adsorption capacity and selectivity for the basic asphaltenes. U.S. Pat. Nos. 2,944,002 and 2,432,644 also disclose the use of solid acid catalysts in guard cases for removing metal and nitrogen-containing catalyst contaminants from feeds being fed to cat crackers. However, none of the processes discloses in these two patents permits an asphalt-containing feed to be fed to the guard case. In fact, U.S. Pat. No. 2,944,002 repeatedly teaches that the feed going to the guard case must first be deasphalted if it is an asphaltene-containing feed.

SUMMARY OF THE INVENTION

It has now been discovered that the basic asphaltenes present in asphalt-containing hydrocarbon feeds or oils are selectively adsorbed onto solid acids, such as solid acid catalysts, to produce an oil of reduced basic asphaltene content, by contacting the feed, in an adsorption zone, with the solid acid catalyst at a temperature no higher than about 575° F. The asphaltene-reduced feed may then be sent to further processing. The basic-asphaltene-containing catalyst is separated from the feed, the basic asphaltenes are cracked off the catalyst and the catalyst is then regenerated and recycled back to the adsorption zone. Contacting at a temperature no higher than about 575° F. avoids cracking the asphaltenes in the adsorption zone.

BRIEF DESCRIPTION OF THE DRAWINGS

The attached FIGURE is a flow diagram of a preferred embodiment of the process of this invention, including regeneration and recycling of the solid acid catalyst back to the adsorption zone.

DETAILED DESCRIPTION

Asphalt-containing hydrocarbon feeds or oils useful in the process of this invention include any naturally occurring, asphalt-containing mineral oils and fractions thereof such as whole and topped crude oils, vacuum and atmospheric residua, etc. as well as asphalt-containing synthetic feeds or oils derived from the liquifaction of coal, from tar sands, Cold Lake crude, etc. The process of this invention is sensitive to the presence of water. Therefore, it is important that the feed not contain too much water, because the solid acid will preferentially adsorb the water at the expense of adsorbing the basic asphaltenes. Hence, the water content of the feed, if any, should be appreciably lower than the basic asphaltene content of the feed. It is preferred that the water content of the feed be less than about 1 wt. %.

Solid acids useful in the process of this invention include any solid materials having Lewis and/or Bronsted acid sites. This, of course, includes all of the well-known acid cracking catalysts, such as silica/alumina. As those skilled in the art know, one of the most widely used and accepted methods for determining the nature and amount of acidity or acid sites on cracking catalysts is the Benesi method employing titration with n-butyl amine (H. A. Benesi, J. Amer. Chem. Soc. 89, 5490 (1956)). In a preferred embodiment of this invention the solid acid is calcined at a temperature of at least about 150° C. prior to being contacted with the asphalt-containing feed. This is done in order to remove any adsorbed water from its surface which would reduce the adsorptive capacity of the solid acid. The minimum calcining conditions will, of course, depend on the solid acid used. It is also preferred that the solid acid also act as a catalyst for subsequently catalytically cracking the adsorbed basic asphaltenes to produce therefrom liquid products boiling below about 1050° F.

The solid acid catalyst can then be regenerated and returned to the adsorption zone.

In the process of this invention, the temperature, pressure and residence time of the asphalt-containing feed in the adsorption zone are not particularly critical as long as the temperature is below about 575° F. and as long as the desired degree of removal of basic asphaltenes from the feed is achieved. It has been found that the solid acid catalyst can adsorb up to about 20% of its weight of basic asphaltenes and, if desired, substantially all of the basic asphaltenes may be removed from the feed in the adsorption zone. Because the heart of the process of this invention is a separation process, the maximum temperature employed in the adsorption zone is limited by the onset of cracking in the adsorption zone. In general, this means that the maximum temperature employed in the adsorption zone will be no greater than about 575° F., preferably no greater than about 550° F., and still more preferably no greater than about 500° F. The minimum pressure is that required to force the asphaltene-containing feed through the adsorption zone.

Thus, the conditions of pressure, temperature and space velocity may be adjusted to suit ones needs. In general, however, the pressure in the adsorption zone will be at least about 25 psig, the temperature will range from about 200°-500° F. with a residence time of the feed in the adsorption zone of from about 2-600 minutes and a liquid hourly space velocity of from about 0.1 to 30 V/V/hr. The bed of solid acid adsorbant may be a fixed or fluid bed or one may use a slurry-plus-settler technique wherein the solid acid and asphalt-containing feed pass cocurrently through the adsorption zone and are than passed to a settling zone to separate the solid acid containing the adsorbed basic asphaltenes from the basic asphaltene-reduced feed. Alternatively, the slurry may be sent to hydroclones or filtration means to separate the basic asphaltene-laden solid acid from the feed. In any event, the solid acid containing the adsorbed basic asphaltenes must be periodically separated from the feed. The basic asphaltenes may then be cracked off to produce liquid and coke, with the coke-laden, solid acid regenerated by any well-known method such as air burning. The regenerated solid acid is then recycled back to the adsorption zone. As previously stated, it is preferred that the solid acid adsorbent also act as a catalyst for cracking the basic asphaltenes adsorbed thereonto.

DESCRIPTION OF A PREFERRED EMBODIMENT

Referring to the FIGURE, an asphaltene-containing feed, such as a crude oil derived from the Cold Lake region of Canada, is heated by means not shown to a temperature of about 300° F. and passed via line 10 to adsorption zone 12 at a pressure of about 50 psig. Adsorption zone 12 operates at a temperature of about 300° F., a pressure of about 25 psig and contains a solid acid such as a solid acid cracking catalyst comprising coprecipitated silica/alumina containing from about 5-40 wt. % alumina and preferrably from about 13-25 wt. % alumina. The residence time of the oil in adsorption zone 12 is about 30 minutes and the ratio of oil to solid acid will generally range from about 1 to 10 volumes of oil to one volume of solid acid, the combination being sufficient for at least about 90 wt. % of the basic asphaltenes present in the feed to be adsorbed onto the solid acid catalyst to produce an oil of reduced basic asphaltene content. The basic asphaltene-reduced oil or feed is removed from adsorption zone 12 via line 14 and sent to further upgrading processes such as hydrocracking, catalytic cracking, hydrorefining, etc. Catalyst particles laden with adsorbed basic asphaltenes are continuously withdrawn from zone 12 via line 16 and passed to cracking zone 18. Cracking zone 18 operates at a temperature above 700° F. and generally ranging from about 800°-1,000° F. and a pressure ranging from atmospheric to about 50 psig. In cracking zone 18, the basic asphaltenes are catalytically cracked off the catalyst particles to produce liquid and gaseous products which are removed from zone 18 via line 20. This cracking also produces coked catalyst. Coked catalyst particles are removed from cracking zone 18, via line 22 and passed to catalyst regeneration zone 24 which operates at a temperature of at least 900° F. and generally from about 1,000°-1,300° F. Air is passed into regeneration zone 24, via line 26 which burns the coke off the catalyst and simultaneously calcines same to produce gaseous products such as carbon monoxide, water, low molecular weight gases, etc., which are removed from regeneration zone 24 via line 28. Regenerated and calcined catalyst is removed from zone 24 via line 30, and recycled back to adsorption zone 12.

The invention will be further understood by reference to the examples below.

EXAMPLE 1

This example establishes the fact that solid acids selectively adsorb basic asphaltenes from a mixture of basic and non-basic asphaltenes. The asphaltenes used in this experiment were precipitated from a 1050° F.+vacuum residuum obtained from a Canadian Cold Lake crude and also from a Tia Juana crude using standard deasphalting procedures employing n-heptane to effect the precipitation. A solution of 3 wt. % of these asphaltenes in toluene was made and a basic/non-basic split made using HCl precipitation according to the Sternberg technique previously discussed. The results are shown in Table 1. Next, samples of commercial silica/alumina cracking catalysts obtained from Grace Chemical Company, containing 13% $Al_2O_3$(DA-1) and 25% $Al_2O_3$(Hi-Al) were calcined at 500° C. for 16 hours and stored in a nitrogen-purged dry box. Toluene solutions of the precipitated asphaltenes were prepared by dissolving 30 grams of the asphaltenes in 300 ml of toluene under nitrogen and stirring for two hours. 120 grams of each catalyst was added to each solution of 30 grams of asphaltenes in the 300 ml of toluene and the mixture or slurry stirred for two hours at ambient temperature under a blanket of nitrogen. The toluene was removed from the slurry on a rotary evaporator and the residue dried in vacuo at 80° C. for 16 hours. The dried material was then placed in a dry box and ground to a particle size that would pass through a 20 mesh screen. This ground material was then charged to a Soxhlet thimble and extracted with tetrahydrofuran until the siphoned liquid was nearly colorless. The tetrahydrofuran, which contained the dissolved non-basic fraction, was removed from the collection flask. Pyridine was then added to the collection flask and the extraction carried out again until the siphoned liquid was nearly colorless. The pyridine fraction contained the dissolved basic fraction which was then also removed from the collection flask. The separated basic and non-basic fractions contained in the pyridine and tetrahydrofuran solutions, respectively, were isolated by evaporating the solvent and drying in vacuum at 80° C.

The results of this experiment are also shown in Table 1 and illustrate the fact that the solid acid catalysts selectively adsorb the basic asphaltenes from the mixture of basic and non-basic asphaltenes.

In order to further substantiate the fact that the solid acid catalyst selectively adsorbed the basic as phaltenes, a portion of both the basic and non-basic asphaltene fractions obtained by contacting the asphaltene-containing toluene solution with the DA-1 catalyst using the technique described above was redissolved in toluene and fractionated again using HCl according to the Sternberg technique. The results disclosed that the non-basic fraction obtained by the DA-1 separation was mostly non-basic according to the HCl test. Correspondingly, the basic asphaltene fraction was found to be mostly basic according to the HCl test.

EXAMPLE 2

In this experiment, samples of basic and non-basic asphaltene fractions obtained from coal liquids and separated by selective adsorption on the DA-1 catalyst using the technique set forth in Example 1 were analyzed by mass spectroscopy. The results indicated that the basic fraction had basic functional groups and that the non-basic fraction had acidic or neutral functional groups. Further, the mass spectroscopy studies indicated that the DA-1 catalyst did a better job of separating the basic and non-basic fractions than could be obtained using the HCl precipitation technique according to Sternberg.

EXAMPLE 3

This experiment serves to demonstrate that it is the acidity of the solid acid or solid acid catalyst which causes the selective adsorption and separation of the basic asphaltenes from the non-basic asphaltenes. This experiment was done in a manner identical to that in Example 1 except that the solid adsorbents used were the DA-1 and a neutral silica gel and the non-basic and basic asphaltenes were removed from the catalyst sequentially using the THF and pyridine using column chromatography at room temperature instead of the Soxhlet extraction. The results are presented in Table 2 and shown that the acidic DA-1 gives a high yield of basic asphaltenes. In contrast, the neutral silica did not adsorb any basic asphaltenes at all.

EXAMPLE 4

This example serves to demonstrate that the solid acid can be heavily loaded with asphaltenes and still selectively adsorb basic asphaltenes from the basic/non-basic asphaltene mixture. This experiment was accomplished using a procedure similar to that in Example 1 wherein asphaltenes were dissolved in toluene which was then slurried with the catalyst followed by drying and crushing. The non-basic and basic asphaltenes were then removed from the catalyst using the column chromatography method of Example 3. The results are given in Table 3 and demonstrate that up to about 20 wt. % of total asphaltenes can be adsorbed on the solid acid without incurring any major change in the basic/non-basic cut point.

EXAMPLE 5

In this experiment, an elemental analysis was made of the basic and non-basic asphaltene fractions obtained by selectively adsorbing the basic fraction on the DA-1 catalyst using the procedure in Example 1. The asphaltenes used in this experiment were derived both from a Canadian Cold Lake crude and from the liquefaction product of Wyodak coal. The results of the analysis are shown in Table 4 and disclose that, with the possible exception of nitrogen content, there is essentially no difference in elemental analysis between the basic and non-basic fractions of each sample. However, both high resolution mass spectroscopy and electrochemical titration has shown that the nitrogen in the basic fraction is basic, while that in the non-basic fraction is non-basic. In the coal derived fractions, the nitrogen and oxygen actually fractionate. However, in this case, the acid phenolic oxygen and the non-basic nitrogen appear in the non-basic fraction, while the ether oxygen and basic nitrogen appear in the basic fraction. Thus, this establishes that elemental analysis alone does not give an indication of basicity.

EXAMPLE 6

In this example, thermal gravimetric analyses were run on samples of DA-1 catalyst which contained (a) basic asphaltene fractions and, (b) non-basic asphaltene fractions, at a loading level of 10 wt. % of asphaltenes on the catalyst. These samples were prepared by slurrying one portion of calcined DA-1 catalyst with a toluene solution of basic asphaltenes and by slurrying another portion of the calcined catalyst with a toluene solution of non-basic asphaltenes. The separate slurrys were then treated using the procedure given in Example 1 to evaporate off the toluene and grinding to a particle size that would pass through a 20 mesh screen. The samples of basic and non-basic asphaltenes were also obtained using the DA-1 separation technique of Example 1.

These experiments showed that on the acid catalyst, the basic asphaltene fractions made considerably more carbon residue than the non-basic fractions, but that about 75% of the carbon could be converted to volatile material, whereas in strictly thermal processing it could only be converted to about 50% volatiles.

EXAMPLE 7

This experiment demonstrates the sensitivity of the solid acid to moisture on the catalyst in the selective separation process of this invention. Samples of asphalt precipitated from both a Canadian Cold Lake crude and a Canadian Cold Lake 1050° F.+ vacuum resid were dissolved in toluene and slurried with samples of the DA-1 catalyst as-received from the manufacturer, and after being calcined at 500° C. Uncalcined catalysts generally contain from about 3–9 wt. % water, with 4–6% representing an average value. The asphalt-containing catalyst was then sequentially extracted with THF and pyridine using the procedure outlined in Example 1. The results of this experiment are shown in Table 5 and, as can be seen from the data, the yield of basic material using calcined DA-1 was substantially greater. This demonstrates that calcining the catalyst increased the adsorbtive capacity of the catalyst for the basic fraction.

EXAMPLE 8

This experiment demonstrates a preferred embodiment of the process of this invention. In this experiment, a tube one inch in diameter and two feet long was filled with DA-1 catalyst that had been calcined in air at 500°

C. A toluene solution of Canadian Cold Lake crude oil was prepared and fed through the tube at ambient temperature in an amount such that a total of 5 volumes of actual crude oil contacted each volume of catalyst in the tube. The oil-laden catalyst was then washed in toluene to remove the non-adsorbed oil and asphaltenes. The washed catalyst was then dried and placed in an oven at 500° C. for one hour in flowing nitrogen to crack off the adsorbed basic asphaltenes which produced gas, cracked liquid products and a coked catalyst. The coked catalyst was then regenerated by contacting same with air diluted with nitrogen at a temperature of 600° C. and the regenerated catalyst then placed back in the tube. This cycle was repeated four times and the results are shown in Table 6. Analysis of the basic and non-basic asphaltene contents of both the crude oil and the basic-asphaltene-reduced oil effluent from the tube containing the DA-1 catalyst was made using the DA-1 adsorption technique with the THF and pyridine Soxhlet extractions as set forth in Example 1.

The results in Table 6 clearly demonstrate the operability of the process of this invention as indicated by the reduced basic-asphaltene content of the crude oil after being passed over the DA-1 catalyst.

TABLE 1

COMPARISON OF METHODS FOR SEPARATING BASIC ASPHALTENES

| Source of Asphaltenes | HCl Precip. wt. % | Solid Acid Adsorption wt. % DA-1 | Hi-Al |
|---|---|---|---|
| Tia Juana | 37.0 | 32.1 | 31.6 |
| Cold Lake | 25 | 32.8 | |

TABLE 2

THE EFFECT OF ADSORBENT ON BASIC ASPHALTENE SEPARATION*

| Source of Asphaltenes | Basic Asphaltene Yield, Wt. % DA-1 | SiGel |
|---|---|---|
| Tia Juana | 32.1 | 0 |
| Arab Heavy | 20.2 | — |

*NOTE:
10 wt. % initial loading of asphaltenes on the solid.

TABLE 3

THE EFFECT OF SOLIDS LOADING ON SEPARATION OF BASIC ASPHALTENES WITH DA-1

| | Loading, Wt. % Asphaltenes* on DA-1 | | |
|---|---|---|---|
| | 10 | 15 | 20 |
| Basic Asphaltene Yield, wt. % of Feed | 32.1 | 31.9 | 27.0–29.4 |

*NOTE: Asphaltenes from Tia Juana Medium crude oil.

TABLE 4

ELEMENTAL ANALYSES OF COLD LAKE AND WYODAK ASPHALTENE FRACTIONS

| | COLD LAKE | | WYODAK | |
|---|---|---|---|---|
| | NON-BASIC | BASIC | NON-BASIC | BASIC |
| % C | 80.72 | 80.60 | 87.72 | 84.10 |
| % H | 7.79 | 7.59 | 6.41 | 6.31 |
| % N | 1.11 | 1.45 | 0.60 | 3.19 |
| % S | 7.76 | 7.65 | 0.60 | 0.60 |
| % O | 2.51 | 2.60 | 3.93 | 5.51 |
| V (PPM) | 813 | 770 | — | — |

TABLE 4-continued

ELEMENTAL ANALYSES OF COLD LAKE AND WYODAK ASPHALTENE FRACTIONS

| | COLD LAKE | | WYODAK | |
|---|---|---|---|---|
| | NON-BASIC | BASIC | NON-BASIC | BASIC |
| Ni (PPM) | 322 | 350 | — | — |

TABLE 5

Yields of Basic and Non-basic Cold Lake Asphaltenes from Calcined and As-received DA-1 Catalyst, wt. %

| Asphaltene Source | Catalyst | Non-Basic | Basic |
|---|---|---|---|
| Cold Lake Crude | Calcined | 62.4 | 37.6 |
| Cold Lake Crude | As-received | 90.9 | 9.1 |
| Cold Lake Resid | Calcined | 62.1 | 37.9 |
| Cold Lake Resid | As-received | 89.8 | 10.2 |

TABLE 6

CYCLIC ADSORPTION AND CRACKING OF COLD LAKE CRUDE OVER DA-1

| | CYCLE 1 | 2 | 3 | 4 |
|---|---|---|---|---|
| Adsorbed crude (wt. % of DA-1) | 28.5 | 20.3 | 21.0 | 19.6 |
| Cracked Liquids (wt. % adsorbed crude) | 41.0 | 38.9 | 42.7 | 43.9 |
| wt. % basic asphaltenes in sorbate | 49.8 | 74.4 | 65.2 | |
| Basic asphaltene content of asphaltenes in effluent after passing over DA-1* | 9.0 | 9.6 | 10.9 | 12.8 |

*NOTE: Basic asphaltene content of asphaltenes in feed was 32 wt. %

What is claimed is:

1. A process for selectively removing basic asphaltenes from a basic asphaltene-containing hydrocarbon feed that contains less than about 1 wt. % water which comprises contacting said feed with a regenerated solid acid catalyst at a temperature below about 575° F. for a time sufficient to selectively absorb at least a portion of said basic asphaltenes onto said solid acid to produce a hydrocarbon feed of reduced basic asphaltene content, wherein said solid acid catalyst has been calcined to remove adsorbed water from the surface thereof prior to being contacted with said feed.

2. The process of claim 1 wherein the solid acid cracking catalyst containing adsorbed basic asphaltenes thereon is separated from the feed, the adsorbed basic asphaltenes are cracked off the catalyst to produce liquid product therefrom and a coked catalyst and wherein the coked catalyst is regenerated and recycled back to the adsorption zone.

3. The process of claim 2 wherein said catalyst also acts as a catalyst for cracking off the adsorbed basic asphaltenes.

4. The process of claim 3 wherein said asphaltenes are cracked off said catalyst at a temperature greater than about 700° F.

5. The process of claim 4 wherein the temperature in said adsorption zone is no higher than about 550° F.

6. The process of claim 5 wherein the temperature in the adsorption zone is no greater than about 500° F.

7. The process of either of claims 1, 5, or 6 wherein said catalyst comprises an amorphous silica/alumina catalyst.

8. A process for selectively removing basic asphaltenes from a basic asphaltene-containing hydrocarbon feed that contains less than about 1 wt. % water comprising the sequential steps of:

(a) contacting said feed, in an adsorption zone at a temperature below about 575° F., with a regenerated solid acid catalyst for a time sufficient to selectively adsorb at least a portion of said basic asphaltenes onto said catalyst and produce a feed of reduced basic asphaltene content wherein said solid acid catalyst has been calcined to remove adsorbed water from the surface thereof prior to being contacted with said feed;

(b) separating said basic asphaltene laden catalyst from said feed;

(c) cracking the basic asphaltenes off said catalyst in a cracking zone at a temperature above about 700° F. to produce liquid product and a coked catalyst;

(d) regenerating and calcining said coked catalyst by burning off the coke and (e) returning the regenerated catalyst back to the adsorption zone.

9. The process of claim 8 wherein said basic asphaltenes are cracked off said catalyst at a temperature of at least about 900° F.

10. The process of claim 9 wherein said catalyst catalytically cracks the basic asphaltenes adsorbed thereon.

* * * * *